US012066032B2

(12) United States Patent
Wu et al.

(10) Patent No.: US 12,066,032 B2
(45) Date of Patent: Aug. 20, 2024

(54) FAN

(71) Applicants: York Guangzhou Air Conditioning and Refrigeration Co., Ltd., Qingyuan (CN); Johnson Controls Tyco IP Holdings LLP, Milwaukee, WI (US)

(72) Inventors: Chenggang Wu, Qingyuan (CN); Bin Yuan, Qingyuan (CN); Xiaokui Ma, Qingyuan (CN); Li Wang, Qingyuan (CN); Jian Zhu, Qingyuan (CN)

(73) Assignees: York Guangzhou Air Conditioning and Refrigeration Co., Ltd., Qingyuan (CN); Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/019,579

(22) PCT Filed: Jul. 23, 2021

(86) PCT No.: PCT/CN2021/108184

§ 371 (c)(1),
(2) Date: Aug. 16, 2023

(87) PCT Pub. No.: WO2022/028261

PCT Pub. Date: Feb. 10, 2022

(65) Prior Publication Data

US 2024/0060505 A1 Feb. 22, 2024

(30) Foreign Application Priority Data

Aug. 4, 2020 (CN) ..... 202010774566.5

(51) Int. Cl.

| | |
|---|---|
| ***F04D 29/32*** | (2006.01) |
| ***F04D 29/34*** | (2006.01) |
| ***F04D 29/66*** | (2006.01) |

(52) U.S. Cl.
CPC ..... *F04D 29/325* (2013.01); *F04D 29/34* (2013.01); *F04D 29/662* (2013.01)

(58) Field of Classification Search
CPC ..... F04D 29/325; F04D 29/34
See application file for complete search history.

(56) References Cited

U.S. PATENT DOCUMENTS 5,927,945 A 7/1999 Chen
6,048,173 A 4/2000 Chen
(Continued)

FOREIGN PATENT DOCUMENTS

CN 106402022 A 2/2017
CN 208885620 U 5/2019
(Continued)

OTHER PUBLICATIONS

PCT International Search Report for PCT Application No. PCT/CN2021/108184, mailed Oct. 27, 2021, 4 pgs.

*Primary Examiner* — Brian O Peters
(74) *Attorney, Agent, or Firm* — Fletcher Yoder, P.C.

(57) ABSTRACT

A fan, comprising blades (102), an upper hub (111), and a lower hub (112). Each blade (102) comprises a connecting part (211). The connecting part (211) is clamped between a lower surface of the upper hub (111) and an upper surface of the lower hub (112). The lower surface of the upper hub (111) is provided with an upper hub connecting area, and the upper surface of the lower hub (112) is provided with a lower hub connecting area. An upper surface and a lower surface of the connecting part (211) are separately provided with a junction surface extending from the connecting part (211). The lower surface of the upper hub (111) and the upper surface of the lower hub (112) are separately provided with a matching surface matching the junction surface. The junction surface and the matching surface are arranged in the radial direction and/or circumferential direction of the upper
(Continued)

hub (111) and the lower hub (112), and are configured to match with each other to impede the movement of at least two blades (102) in the circumferential direction and/or radial direction with respect to the upper hub (111) and the lower hub (112). The fan structure can prevent the movement of the blades (102) with respect to the upper hub (111) and the lower hub (112). The connecting part (211) and the fan body (201) are not easy to break and can be easily assembled, such that better stability can be ensured while the cost is low.

8 Claims, 4 Drawing Sheets

(56) References Cited

U.S. PATENT DOCUMENTS

| | | | | |
|---|---|---|---|---|
| 2013/0336797 | A1* | 12/2013 | Wang | F04D 29/329<br>416/214 R |
| 2019/0120246 | A1 | 4/2019 | Martini et al. | |

FOREIGN PATENT DOCUMENTS

| | | | |
|---|---|---|---|
| CN | 209925296 | U | 1/2020 |
| CN | 210859327 | U | 6/2020 |

* cited by examiner

FAN

FIELD OF THE INVENTION

The present application relates to the field of rotating machinery, and more specifically, to a fan.

DESCRIPTION OF THE RELATED ART

An existing fan comprises an upper hub, a lower hub, and at least two blades, and the at least two blades are clamped between the upper hub and the lower hub. The portion of a blade that is clamped between the upper hub and the lower hub is generally designed to be cylindrical. However, the clamped portion has a large volume, while the blade is relatively thin. When the fan starts up, the blades tend to break at the roots thereof.

SUMMARY OF THE INVENTION

Exemplary embodiments of the present application can solve at least some of the above problems.

The present application provides a fan, comprising at least two blades, an upper hub, and a lower hub, where each of the at least two blades comprise a connecting part. The upper hub and the lower hub are coaxially arranged with respect to the axis of the fan, and can rotate around the axis of the fan, and the connecting parts of the at least two blades are clamped between a lower surface of the upper hub and an upper surface of the lower hub and are arranged around the fan axis. Wherein, the lower surface of the upper hub is provided with at least two upper hub connecting areas, and the at least two upper hub connecting areas are provided correspondingly with the connecting parts of the at least two blades. Wherein, the upper surface of the lower hub is provided with at least two lower hub connecting areas, and the at least two lower hub connecting areas are provided correspondingly with the connecting parts of the at least two blades. Wherein, an upper surface and a lower surface of the connecting parts are respectively provided with at least one junction surface extending from the connecting parts, the lower surface of the upper hub and the upper surface of the lower hub are respectively provided with at least one matching surface for matching the junction surface, the at least one junction surface and the at least one matching surface are arranged in the radial direction and/or the circumferential direction of the upper hub and the lower hub, and are configured to match with each other to impede the movement of the at least two blades in the circumferential direction and/or the radial direction with respect to the upper hub and the lower hub.

According to the above-described fan, the at least one junction surface is formed by at least one rib provided on the connecting part, and the at least one matching surface is formed by at least one rib provided on the lower surface of the upper hub and the upper surface of the lower hub.

According to the above-described fan, the at least one rib comprises a plurality of ribs, one part of the plurality of ribs extend in the circumferential direction to form a junction surface extending in the circumferential direction, and the other part of the plurality of ribs extend in the radial direction to form a junction surface extending in the radial direction.

According to the above-described fan, the ribs extending in the circumferential direction and the ribs extending in the radial direction comprise at least one group of ribs, wherein each group of ribs in the at least one group of ribs comprises one inner circumferential rib, one outer circumferential rib, and one radial rib, the radial rib is connected with the inner circumferential rib and the outer circumferential rib, and a connection hole is provided at the place where the radial rib is connected with the outer circumferential rib.

According to the above-described fan, each group of ribs in the at least one group of ribs is integrally formed.

According to the above-described fan, the inner circumferential ribs on the connecting parts of the at least two blades are arranged along an inner circumferential circle.

According to the above-described fan, the inner circumferential ribs on the connecting parts of the adjacent blades in the at least two blades abut against each other.

According to the above-described fan, each of the at least two blades further comprises a vertical plate extending transversely to and around the connecting part.

According to the above-described fan, each of the at least two blades is integrally formed using plastic.

According to the above-described fan, the upper hub is provided with a protruding ring, the protruding ring protrudes from the upper surface of the upper hub, and the protruding ring is configured for assembling a counterweight blocks.

The blades of the fan of the present application can prevent the movement relative to the upper hub and the lower hub, it is not easy to break the connecting part from the blade body, and the assembly is simple and low cost while ensuring better stability.

BRIEF DESCRIPTION OF THE DRAWINGS

The features and advantages of the present application can be better understood by reading the following detailed description with reference to the accompanying drawings. In all the accompanying drawings, identical reference numerals refer to identical parts, wherein.

DETAILED DESCRIPTION OF THE EMBODIMENT

Figure 1A:
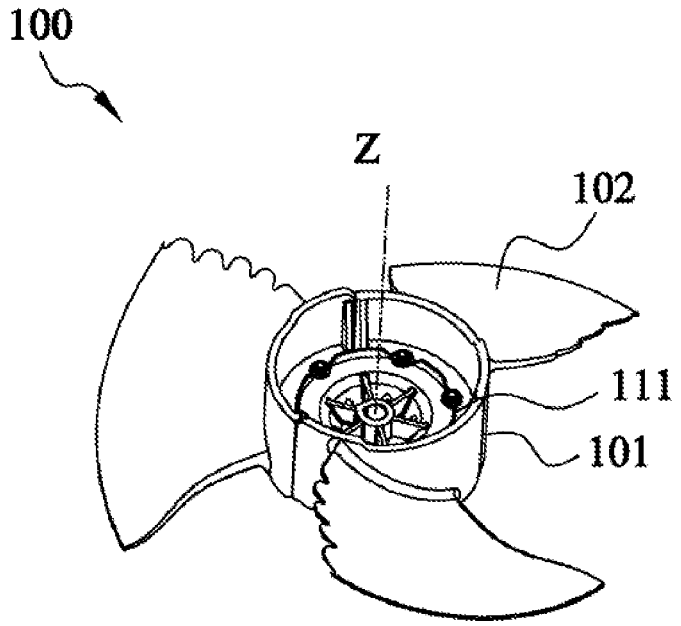
FIG. 1A is a perspective view of a fan according to the embodiment of the present application.

Various specific embodiments of the present application will be described below with reference to the accompanying drawings that form a part of this specification. It should be understood that, in the following drawings, the same reference numerals are used for the same parts, and similar reference numerals are used for similar parts.

Various specific embodiments of the present application will be described below with reference to the accompanying drawings that form a part of this specification. It should be understood that although directional terms such as "upper," "lower," "left," "right," etc. are used in the present application to describe various example structural parts and elements of the present application, these terms are used herein for convenience of description only, and these terms are determined based on the exemplary orientations shown in the figures. Since the embodiments disclosed in the present application may be arranged in different orientations, these directional terms are used for illustration only and should not be regarded as limiting.

Figure 1B:
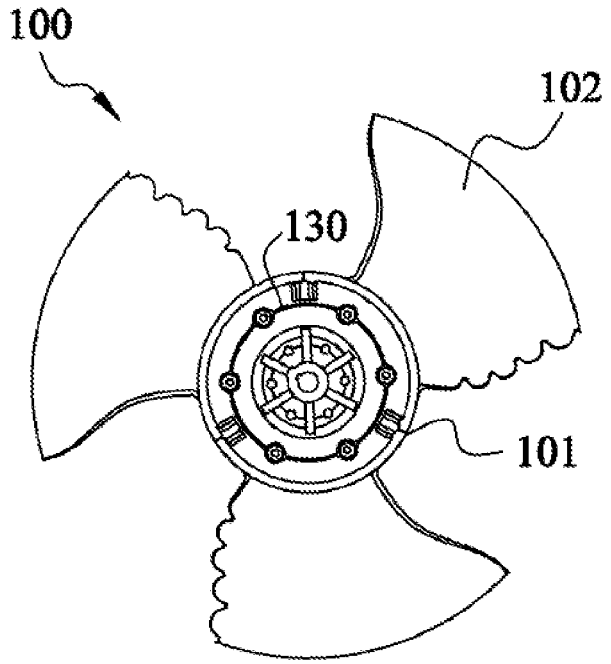
FIG. 1B is a top view of the fan shown in FIG. 1A.
Figure 1C:
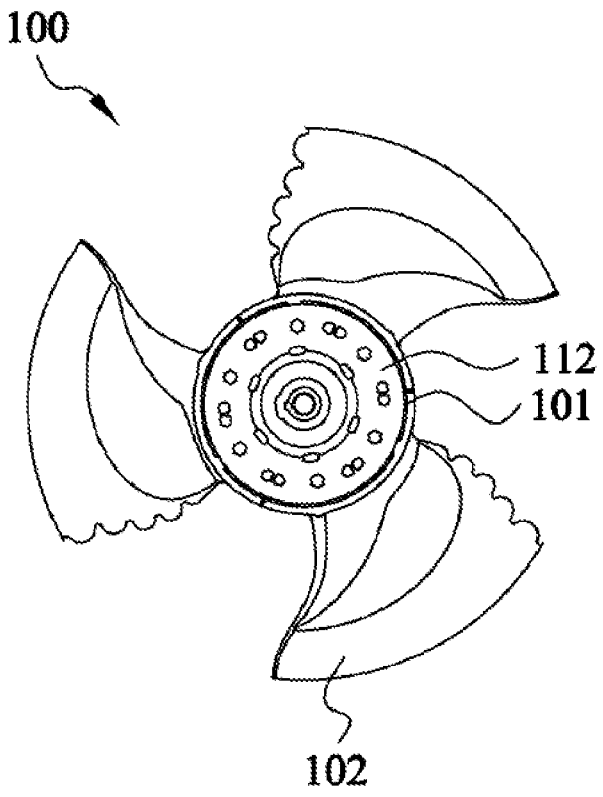
FIG. 1C is a bottom view of the fan shown in FIG. 1A.

FIGS. 1A-1C are a perspective view, a top view, and a bottom view of the fan 100 of the present application, respectively. As shown in FIGS. 1A-1C, the fan 100 comprises a hub 101 and three blades 102. The hub 101 can rotate around the axis Z of the fan. The three blades 102 are evenly arranged around the fan axis Z and connected to the hub 101. When the hub 101 rotates around the fan axis Z, the three blades 102 can also rotate around the fan axis Z.

The hub 101 comprises an upper hub 111 and a lower hub 112. The upper hub 111 and the lower hub 112 are coaxially disposed with respect to the fan axis Z and can rotate around the fan axis Z together. Each of the three blades 102 comprises a connecting part 211 (see FIG. 2A and FIG. 2B). The connecting parts 211 of the three blades 102 are clamped by the upper hub 111 and the lower hub 112. A connecting member 113 runs through the upper hub 111, the connecting part 211, and the lower hub 112 to connect the three blades 102 together with the hub 101.

Figure 2A:
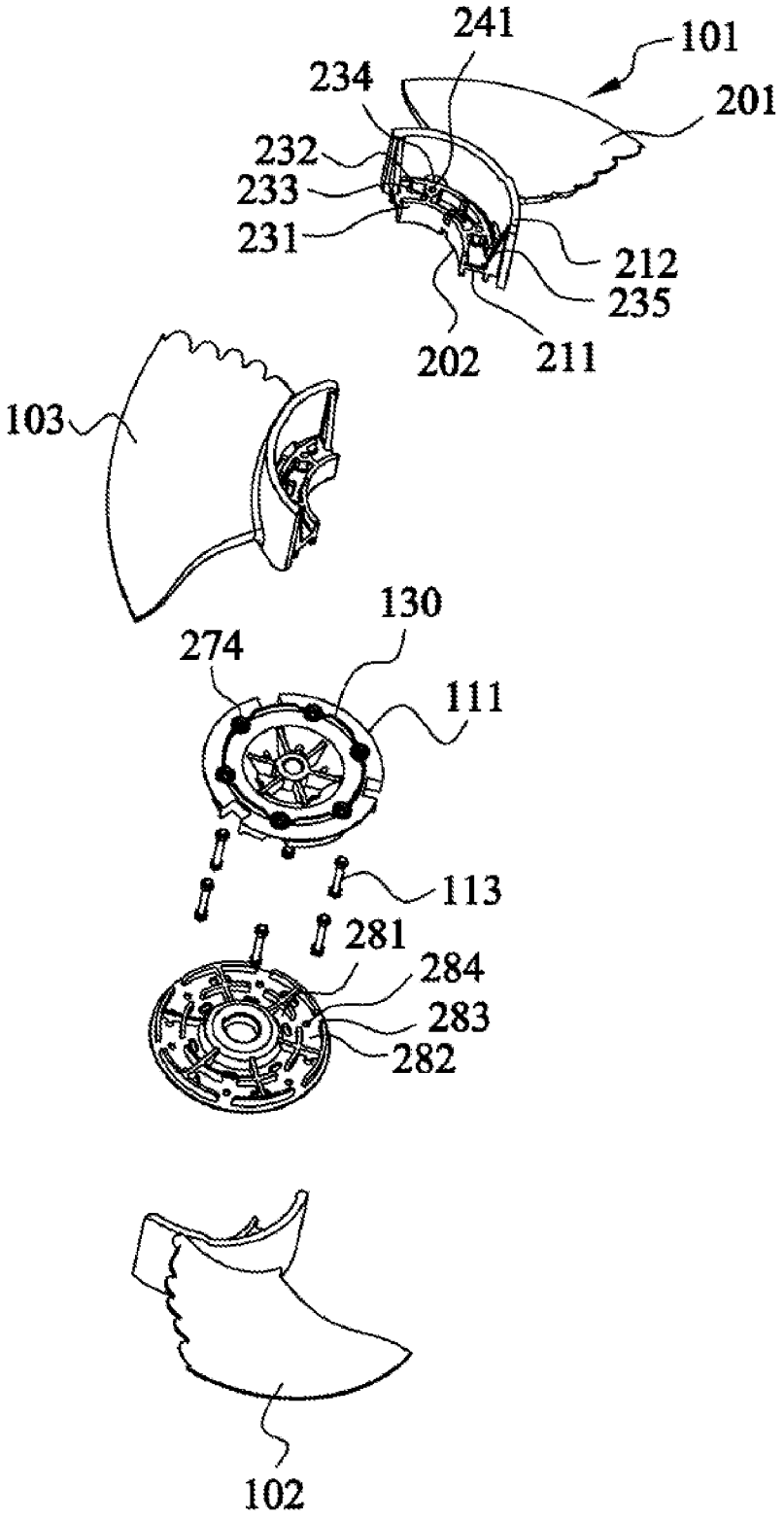
FIG. 2A is an exploded view of the fan shown in FIG. 1A from above.
Figure 2B:
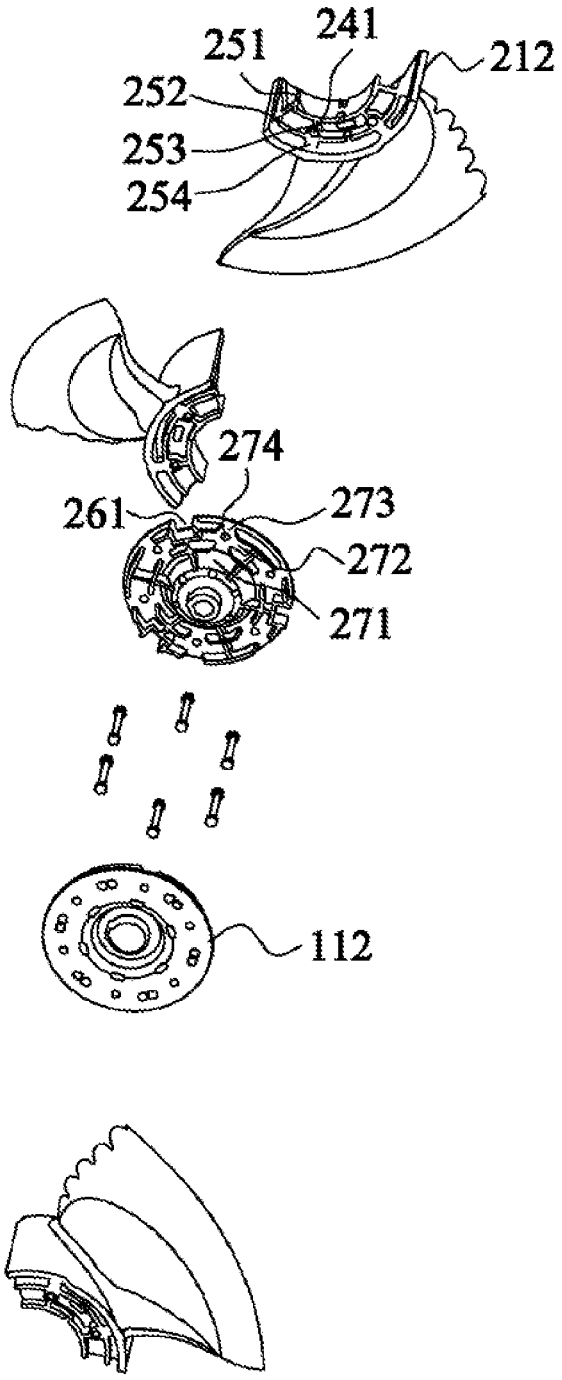
FIG. 2B is an exploded view of the fan shown in FIG. 1A from below.

FIGS. 2A-2B are exploded views of the fan 100 of the present application viewed from the top and from the bottom, respectively. As shown in FIGS. 2A-2B, the lower surface of the upper hub 111 is provided with three upper hub connecting areas corresponding to the three blades 102, and the upper surface of the lower hub 112 is provided with three lower hub connecting areas corresponding to the three blades 102. Since all the three blades 102 have the same structure, the three upper hub connecting areas all have the same structure, and the three lower hub connecting areas also all have the same structure.

Those skilled in the art will understand that, although three blades 102 are shown, and three upper hub connecting areas and three lower hub connecting areas are shown in the present application, the implementations with at least two blades all fall within the protection scope of the present application, as long as a corresponding number of upper hub connecting areas and lower hub connecting areas are provided on the lower surface of the upper hub 111 and the upper surface of the lower hub 112.

For the sake of brevity, the present application takes one blade 102 and its corresponding upper hub connecting area and lower hub connecting area as an example for description.

The blade 102 comprises a connecting part 211, a vertical plate 212, and a blade body 201. The vertical plate 212 is disposed between the connecting part 211 and the blade body 201. Specifically, the connecting part 211 and the blade body 201 are disposed on two sides of the vertical plate 212. The connecting part 211 is formed by extending substantially in the horizontal direction, so as to be sandwiched between the upper hub 111 and the lower hub 112. The vertical plate 212 extends transversely to the connecting part 211, and the vertical plate 212 can wrap around at least a part of the outer circumference of the hub 101. In the circumferential direction of the hub 101, the vertical plate 212 extends beyond the connecting part 211, so that when the three blades 102, the upper hub 111, and the lower hub 112 are assembled in place, the vertical plates 212 of two adjacent blades 102 abut against each other to maintain the relative stability between the two adjacent blades 102.

In the present application, the fan 100 comprises three blades 102, and the connecting parts 211 of all the blade 102 are in contact with each other. In other words, the connecting part 211 of each of the blades 102 is shaped as a 120° ring. That is, the left radial edge and the right radial edge of the connecting part 211 of each of the blades 102 are at an angle of 120°.

The upper surface of the connecting part 211 comprises two groups of ribs. The ribs in the two groups of ribs are arranged in the same manner and symmetrically with respect to a radial direction between the two groups of ribs. As an example, each group of ribs in the two groups of ribs are integrally formed. Each group of ribs comprises one inner circumferential rib 231, one outer circumferential rib 232, and one radial rib 233. The inner circumferential rib 231, the outer circumferential rib 232, and the radial rib 233 are all formed by extending upward from the upper surface of the connecting part 211. Specifically, the inner circumferential rib 231 is connected to the circumferential inner edge of the connecting part 211 and arranged along the inner circumference. The radial rib 233 is arranged in the radial direction, one end of the radial rib 233 is connected with the inner circumferential rib 231, and the other end of the radial rib 233 is connected with the outer circumferential rib 232. The circumferential rib 232 is arranged at a certain distance from the vertical plate 212. The upper surface of the connecting part 211 further comprises auxiliary ribs 234 arranged in the radial direction with one end connected with the outer circumferential rib 232 and the other end connected with the vertical plate 212. As an example, the auxiliary ribs 234 are arranged along the same radius as the radial ribs 233. When the three blades 102, the upper hub 111, and the lower hub 112 are assembled in place, the inner circumferential ribs 231 of two adjacent blades 102 abut against each other to maintain the relative stability between the two adjacent blades 102.

Similarly, the lower surface of the connecting part 211 also comprises two groups of ribs. The ribs in the two groups of ribs are arranged in the same manner and symmetrically with respect to a radial direction between the two groups of ribs. As an example, each group of ribs in the two groups of ribs are integrally formed. Each group of ribs comprises one inner circumferential rib 251, one outer circumferential rib 252, and one radial rib 253. The inner circumferential rib 251, the outer circumferential rib 252, and the radial rib 253 are all formed by extending downward from the lower surface of the connecting part 211. Specifically, the inner circumferential rib 251 is connected to the circumferential inner edge of the connecting part 211 and arranged along the inner circumference. The radial rib 253 is arranged in the radial direction, one end of the radial rib 253 is connected with the inner circumferential rib 251, and the other end of the radial rib 253 is connected with the outer circumferential rib 252. The outer circumferential rib 252 is arranged at a certain distance from the vertical plate 212. The lower surface of the connecting part 211 further comprises auxiliary ribs 254 arranged in the radial direction with one end connected with the outer circumferential rib 252 and the other end connected with the vertical plate 212. As an example, the auxiliary ribs 254 are arranged along the same radius as the radial ribs 253. When the three blades 102, the upper hub 111, and the lower hub 112 are assembled in place, the inner circumferential ribs 251 of two adjacent blades 102 abut against each other to maintain the relative stability between the two adjacent blades 102.

In the examples of the present application, the two groups of ribs on the upper surface of the connecting part 211 and the two groups of ribs on the lower surface of the connecting part 211 need to be symmetrical with respect to the connecting part 211. A connecting hole 241 is provided at the connection between the radial rib 233 and the outer circumferential rib 232 and at the connection between the radial rib 253 and the outer circumferential rib 252, and vertically runs through the rib and the connecting part 211 for receiving the connecting member 113.

In addition, as shown in FIG. 2A, radial reinforcing ribs 235 are provided at the left and right edges of the vertical plate 212 to increase the strength of the vertical plate 212 and to prevent the vertical plate 212 from being deformed by force. Specifically, one end of the radial reinforcing rib 235 is connected to the upper part of the vertical plate 212, and the other end of the radial reinforcing rib 235 is connected to the radial edges (i.e., the left and right edges) of the upper surface of the connecting part 211.

During the production of the blades 102, the blades 102 are manufactured on a large scale. The manufactured blades 102 need to be temporarily stacked at a processing site to save storage space. The blades 102 in the present application can be stacked vertically using vertical plates 212. More specifically, the vertical plate 212 of one blade 102 can abut against the vertical plate 212 of another blade 102 to maintain the stability of one blade 102 and another adjacently placed blade 102.

In the examples of the present application, the blades 102 can be integrally formed using plastic, and can be integrally formed by an injection molding process.

As shown in FIG. 2B, the left and right ends of the outer circumferential edge of the upper hub connecting area are provided with reinforcing rib recesses 261 for accommodating the radial reinforcing ribs 235 of the blade 102. The upper hub connecting area comprises two groups of upper hub recesses, which are provided corresponding to the two groups of ribs on the lower surface of the connecting part 211. The recesses in the two groups of upper hub recesses are arranged in the same manner and symmetrically with respect to a radial direction between the two groups of recesses. Each group of the upper hub recesses comprises one inner circumferential rib recess 271, one outer circumferential rib recess 272, and one radial rib recess 273. The inner circumferential rib recess 271, the outer circumferential rib recess 272, and the radial rib recess 273 are all formed by receding upward on the lower surface of the upper hub 111. The inner circumferential rib recess 271 and the outer circumferential rib recess 272 are both disposed substantially in the circumferential direction of the upper hub 111, the inner circumferential rib recess 271 is provided to accommodate the inner circumferential rib 231, and the outer circumferential rib recess 272 is provided to accommodate the outer circumferential rib 232. The radial rib recess 273 is disposed in the radial direction of the upper hub 111 and provided to accommodate the radial rib 233. A connecting hole 274 is further provided in the upper hub connecting area. The connecting hole 274 is disposed at the connection between the radial rib recess 273 and the outer circumferential rib recess 272 and is provided corresponding to the connecting hole 241. When the three blades 102 and the upper hub 111 are assembled in place, the connecting hole 274 can be aligned with the connecting hole 241 for receiving the connecting member 113.

Similarly, as shown in FIG. 2A, the lower hub connecting area comprises two groups of lower hub recesses, which are provided corresponding to the two groups of ribs on the lower surface of the connecting part 211. The recesses in the two groups of lower hub recesses are arranged in the same manner and symmetrically with respect to the radial direction. Each group of the lower hub recesses comprises one inner circumferential rib recess 281, one outer circumferential rib recess 282, and one radial rib recess 283. The inner circumferential rib recess 281, the outer circumferential rib recess 282, and the radial rib recess 283 are all formed by receding downward on the upper surface of the lower hub 112. The inner circumferential rib recess 281 and the outer circumferential rib recess 282 are both disposed substantially in the circumferential direction of the lower hub 112, the inner circumferential rib recess 281 is provided to accommodate the inner circumferential rib 251, and the outer circumferential rib recess 282 is provided to accommodate the outer circumferential ribs 252. The radial rib recess 283 is disposed in the radial direction of the lower hub 112 and provided to accommodate the radial rib 253. A connecting hole 284 is further provided in the lower hub connecting area. The connecting hole 284 is provided at the connection between the radial rib recess 283 and the outer circumferential rib recess 282 and is provided corresponding to the connecting hole 241. When the three blades 102 and the lower hub 112 are assembled in place, the connecting hole 284 can be aligned with the connecting hole 241 for receiving the connecting member 113.

For a conventional fan, the end of a blades is provided with a spherical portion that is clamped between an upper hub and a lower hub. The mass of the spherical portion is equivalent to the mass of the blade body, so as to maintain the balance of the blade. When the blade, the upper hub, and the lower hub are assembled in place and the fan is running (i.e., the fan is rotating about the fan axis Z), each of the blades is subjected to forces in two directions, that is, a force in the radial direction and a force in the circumferential direction perpendicular to the radial direction. The force in the radial direction causes each of the blades to develop a tendency of moving away from the fan axis Z, while the force in the circumferential direction perpendicular to the radial direction causes each of the blades to develop a tendency of rotating around the fan axis Z with respect to the upper hub and the lower hub. However, since the mass of the spherical portion is equivalent to the mass of the blade body, the spherical portion will break with the blade body due to the force in the radial direction and the force in the circumferential direction when the fan is running.

However, in the fan 100 of the present application, the upper surface of the connecting part 211 is provided with circumferential ribs, and the lower surface of the upper hub 111 is provided with axial recesses. The circumferential rib on the upper surface of the connecting part 211 forms a junction surface, and the wall of the circumferential recess on the lower surface of the upper hub 111 forms a matching surface. The junction surface and the matching surface are configured to match with each other to impede the movement of the three blades 102 with respect to the upper hub 111 and the lower hub 112 in the radial direction. Similarly, the lower surface of the connecting part 211 is provided with circumferential ribs, and the upper surface of the lower hub 112 is provided with circumferential recesses. The circumferential rib on the lower surface of the connecting part 211 forms a junction surface, and the wall of the circumferential recess on the upper surface of the lower hub 112 forms a matching surface. The junction surface and the matching surface are configured to match with each other to impede the movement of the three blades 102 with respect to the upper hub 111 and the lower hub 112 in the radial direction. More specifically, the outer circumferential surface of the inner circumferential rib 231 and the outer circumferential surface of the outer circumferential rib 232 among the ribs on the upper surface of the connecting part 211 can both form a junction surface, and the outer peripheral wall of the inner circumferential rib recess 271 and the outer peripheral wall of the outer circumferential rib recess 272 in the lower surface of the upper hub 111 can both form a matching surface. When the fan 100 is running, the matching surface on the upper hub 111 can contact the junction surface on the blade 102 to prevent the blade 102 from being subjected to a force in the radial direction that causes a tendency of moving away from the fan axis Z. Similarly, the outer circumferential surface of the inner circumferential rib 251 and the outer circumferential surface of the outer circumferential rib 252 among the ribs on the lower surface of the connecting part 211 can both form a junction surface, and the outer peripheral wall of the inner circumferential rib recess 281 and the outer peripheral wall of the outer circumferential rib recess 282 in the upper surface of the lower hub 112 can both form a matching surface. When the fan 100 is running, the matching surfaces on the lower hub 112 can contact the junction surface on the blade 102 to prevent the blade 102 from being subjected to a force in the radial direction that causes a tendency of moving away from the fan axis Z.

In addition, in the fan 100 of the present application, the upper surface of the connecting part 211 is provided with radial ribs, and the lower surface of the upper hub 111 is provided with radial recesses. The radial ribs on the upper surface of the connecting part 211 form junction surfaces, and the walls of the radial recesses on the lower surface of the upper hub 111 form matching surfaces. The junction surfaces and the matching surfaces are configured to match with each other to impede the movement of the three blades 102 with respect to the upper hub 111 and the lower hub 112 in the circumferential direction. Similarly, the lower surface of the connecting part 211 is provided with radial ribs, and the upper surface of the lower hub 112 is provided with radial recesses. The radial ribs on the lower surface of the connecting part 211 form junction surfaces, and the walls of the radial recesses on the upper surface of the lower hub 112 form matching surfaces. The junction surfaces and the matching surfaces are configured to match with each other to impede the movement of the three blades 102 with respect to the upper hub 111 and the lower hub 112 in the circumferential direction. More specifically, as shown in FIG. 1B, the fan 100 rotates counterclockwise about the fan axis Z. At this point, the matching surfaces on the upper hub 111 and the lower hub 112 can contact the junction surfaces on the blades 102 to prevent the blades 102 from being subjected to a force in the circumferential direction that causes a tendency of rotating around the fan axis Z with respect to the upper hub 111 and the lower hub 112. Thus, the blades 102 in the present application can prevent the movement relative to the upper hub 111 and the lower hub 112.

Those skilled in the art may understand that, although the circumferential ribs, circumferential recesses, radial ribs, and radial recesses are used as examples in the present application to show the advantages of the matching between the junction surfaces and the matching surfaces, ribs and recesses of other shapes all fall within the scope of protection of the present application. Those skilled in the art may also understand that, although ribs being provided on the blades and recesses being provided on the upper hub and the lower hub are used as an example in the present application to show the advantages of the matching between the junction surfaces and the matching surfaces, recesses may also be formed on the blades, and ribs may also be provided on the upper hub and the lower hub to form the junction surfaces and the matching surfaces.

In addition, the connecting part 211 of the blade 102 in the present application is provided in a flat shape, and the vertical plate 212 is provided between the connecting part 211 and the blade body 201 to increase the contact area between the connecting part 211 and the blade body 201, so that it is not easy to break the connecting part 211 from the blade body 201.

Furthermore, the connection between the blade 102 and the upper hub 111 and the lower hub 112 in the present application can be implemented by relying on the connecting member 113. The assembly is simple and low cost while ensuring better stability.

Continuing to refer to FIG. 1B and FIG. 2A, the fan 100 further comprises a protruding ring 130. The protruding ring 130 protrudes upward from the upper surface of the upper hub 111. The protruding ring 130 is configured for assembling counterweight blocks, so as to adjust the center of gravity of the fan 100. The protruding ring 130 extends in the circumferential direction, and therefore, counterweight blocks can be arranged in the 360° circumferential direction, which can provide the maximum adjustment range. In the embodiments of the present application, the circumference where the protruding ring 130 is located coincides with the circumference where a plurality of connecting holes 274 are located. The counterweight blocks can be clamped on the protruding ring 130.

Only some features of the present application are illustrated and described herein, but to those skilled in the art, various improvements and modifications may be carried out. Therefore, it should be understood that the appended claims are intended to cover all the above-described improvements and modifications that fall within the scope of substantial spirit of the present application.

The invention claimed is:

1. A fan, comprising: at least two blades, each of the at least two blades comprising a connecting part; and an upper hub and a lower hub, where the upper hub and the lower hub are coaxially arranged with respect to a fan axis, and can rotate around the fan axis, and the connecting parts of the at least two blades are clamped between a lower surface of the upper hub and an upper surface of the lower hub, and arranged around the fan axis; wherein the lower surface of the upper hub is provided with at least two upper hub connecting areas, and the at least two upper hub connecting areas are provided correspondingly with the connecting parts of the at least two blades; wherein the upper surface of the lower hub is provided with at least two lower hub connecting areas, and the at least two lower hub connecting areas are provided correspondingly with the connecting parts of the at least two blades; and wherein an upper surface of the connecting parts and a lower surface of the connecting parts are respectively provided with at least one junction surface extending from the connecting parts, the lower surface of the upper hub and the upper surface of the lower hub are respectively provided with at least one matching surface for matching the at least one junction surface, the at least one junction surface and the at least one matching surface are arranged in a radial direction and/or a circumferential direction of the upper hub and the lower hub, and are configured to match with each other to impede movement of the at least two blades in the circumferential direction and/or the radial direction with respect to the upper hub and the lower hub; wherein the at least one junction surface is formed by at least one rib provided on the connecting part, and the at least one matching surface is formed by at least one rib provided on the lower surface of the upper hub and the upper surface of the lower hub; and wherein the at least one rib provided on the connecting part comprises a plurality of ribs, one part of the plurality of ribs extends in the circumferential direction to form the at least one junction surface extending in the circumferential direction, and the other part of the plurality of ribs extends in the radial direction to form the at least one junction surface extending in the radial direction.

2. The fan according to claim 1, characterized in that the ribs extending in the circumferential direction and the ribs extending in the radial direction comprise at least one group of ribs, wherein each group of ribs in the at least one group of ribs comprises one inner circumferential rib, one outer circumferential rib, and one radial rib, the radial rib is connected with the inner circumferential rib and the outer circumferential rib, and a connection hole is provided at a place where the radial rib is connected with the outer circumferential rib.

3. The fan according to claim 2, characterized in that each group of ribs in the at least one group of ribs is integrally formed.

4. The fan according to claim 2, characterized in that the inner circumferential ribs on the connecting parts of the at least two blades are arranged along an inner circumferential circle.

5. The fan according to claim 3, characterized in that the inner circumferential ribs on the connecting parts of adjacent blades in the at least two blades abut against each other.

6. The fan according to claim 1, characterized in that each of the at least two blades further comprises a vertical plate extending transversely to and around the connecting part.

7. The fan according to claim 1, characterized in that each of the at least two blades is integrally formed using plastic.

8. The fan according to claim 1, characterized in that the upper hub is provided with a protruding ring, the protruding ring protrudes from an upper surface of the upper hub, and the protruding ring is configured for assembling a counterweight block.

* * * * *